US005553777A

United States Patent [19]

Lampe

[11] Patent Number: 5,553,777

[45] Date of Patent: Sep. 10, 1996

[54] RAILROAD TIE PRODUCT AND METHOD THEREFOR

[76] Inventor: David A. Lampe, 228 E. Meyers Ave., Pittsburgh, Pa. 15210

[21] Appl. No.: 304,375

[22] Filed: Sep. 12, 1994

[51] Int. Cl.[6] ..... E01B 3/00

[52] U.S. Cl. ..... 238/35

[58] Field of Search ..... 238/36, 29, 30, 238/37, 83, 35

[56] References Cited

U.S. PATENT DOCUMENTS

| | | | |
|---|---|---|---|
| 598,127 | 2/1898 | Williams . | |
| 679,211 | 7/1901 | Booth | 238/35 |
| 985,470 | 2/1911 | Sykes . | |
| 1,072,053 | 9/1913 | Stoneback | 238/35 |
| 1,153,387 | 9/1915 | Houghton | 238/35 |
| 1,169,158 | 1/1916 | Houghton | 238/35 |
| 1,195,791 | 8/1916 | Duncan | 238/35 |
| 1,231,428 | 6/1917 | Revert . | |
| 1,250,194 | 12/1917 | Lietz . | |
| 1,418,708 | 6/1922 | Hardman . | |
| 2,257,833 | 10/1941 | Baseler et al. | 238/83 |
| 4,105,159 | 8/1978 | Brown | 238/36 |
| 4,286,753 | 9/1981 | Lee | 238/37 |
| 4,326,669 | 4/1982 | Moult et al. | 238/36 |

*Primary Examiner*—Matthew C. Graham
*Assistant Examiner*—C. T. Bartz
*Attorney, Agent, or Firm*—Webb Ziesenheim Bruening Logsdon Orkin & Hanson, P.C.

[57] ABSTRACT

A method to form a new tie from used railroad ties includes the steps of removing metal from the used ties, planing three sides of each of the used ties, cross-cutting both ends of the ties, rip-sawing the ties into 1 to 2.33-inch strips, cross-cutting the strips to 18–96 inches. The method further includes rip cutting the resulting pieces into suitable sizes for gluing having complementary widths, roll coating the pieces with a coupling agent, applying adhesives and assembling the pieces into a beam. The beam is held in a clamp while allowing the adhesive to cure in room temperature and then is cross cut into proper length ties. The new ties are allowed to cure for another seven days prior to creosote treatment.

16 Claims, 2 Drawing Sheets

RAILROAD TIE PRODUCT AND METHOD THEREFOR

BACKGROUND OF THE INVENTION

1. Field of the Invention

The present invention relates to a method of recycling used wooden railroad ties and to the resultant structure of the recycled wooden ties.

2. Description of the Prior Art

Hardwood railroad ties are originally produced by traditional sawmill methods, i.e., cutting trees into the proper rectangular shape using rip saws and cross-cut saws. A rip saw is a saw used to cut wood in a direction generally parallel to the grain of the wood. Similarly, cross-cutting is the cutting of wood in a direction generally perpendicular to the grain of the wood. The trees are usually cut in such a manner that the grain of the tree is generally parallel to the longitudinal direction of the tie. The properly cut pieces are then coated with a preservative such as creosote and baked under heat and pressure to force the preservative into the wood fibers.

After installation into the track, the ties begin to degrade because of exposure to the weather, such as sunlight, particularly ultraviolet radiation, and because of physical forces exerted upon the ties by the trains. Eventually, the tie will "wear out" and need to be replaced. Railroad maintenance personnel routinely inspect ties when they are performing maintenance on the tracks. If they feel that a tie is excessively split or cannot properly hold spikes any longer, the tie is removed from the tracks and replaced with a new one.

The method of cutting trees to construct railroad ties has some disadvantages. It is not a cost-effective method, especially in view of the recent price increase of raw wood. Another disadvantage in utilizing a tree is that it leaves a lot of waste wood. Further, from an environmental viewpoint, it depletes an already depleted hardwood resource.

There have been numerous inventions related to various ways to construct wooden railroad ties from new and smaller wooden pieces. For example, U.S. Pat. No. 4,105,159 discloses a method of constructing wooden railroad ties from wooden plates and particle boards. U.S. Pat. No. 4,326,669 also discusses a use of unused wooden pieces disposed in different directions to form a railroad tie so as to maximize the mechanical strength of the tie utilizing the dependence of properties of wood pieces on grain directions.

The methods used to construct railroad ties disclosed in the references mentioned above utilize smaller pieces of wood than a railroad tie. These methods may, therefore, make use of wood in smaller than tie-size pieces. However, they do not eliminate the need for new pieces of wood which are costly and which has the other disadvantages previously discussed.

The other end of the spectrum in conserving wood is the use of artificial materials to construct railroad ties. Artificial ties made from concrete and other materials last longer than hardwood ties, but are not widely used by railroad companies because they require special handling and fastening procedures and are also considerably more expensive.

There has been an attempt to recycle used hardwood ties by grinding the used railroad ties into chips and mixing the chips with a phenolic resin and then molding the mixture into new ties using heat and pressure. The product was not a commercial success primarily because the finished product resembled artificial ties too closely in cost and performance.

Therefore, a need remains for a way to manufacture new railroad ties from recycled wooden ties in a cost-effective manner.

It is an object of the present invention to provide a method to recycle used railroad ties.

SUMMARY OF THE INVENTION

The present invention provides a solution to problems facing the methods of constructing railroad ties disclosed in the prior art discussed above. The present invention relates to a method of recycling used railroad ties and a method of constructing new railroad ties from the recycled wood portions. It also relates to the structure of recycled wooden ties so constructed.

The method to recycle used wooden railroad ties, according to the present invention, comprises the steps of 1) removing an unrecyclable surface portion of used railroad ties, 2) cutting said used railroad ties into a plurality of usable wooden pieces having complementary dimensions whereby said wooden pieces may be assembled into a beam having a width and height of a railroad tie without leaving substantial space between any two adjacent wooden pieces, 3) applying an adhesive agent to a surface on each of said usable wooden pieces, 4) assembling said usable wooden pieces into a beam having a plurality of layers of said usable wooden pieces and 5) having a width and height of a railroad tie and allowing said adhesive agent to cure. Thereafter, the tie is cut to length from the beam.

One of the problems associated with recycling wooden material from used railroad ties is that the used railroad ties may have unrecyclable portions which need to be removed. This process is labor intensive and should be performed efficiently. A preferred embodiment of the present invention provides an efficient way to recycle used railroad ties into new railroad ties by removing undesired portions of the used ties with a minimum amount of labor. The preferred embodiment also provides a way to optimize the amount of recyclable wooden pieces.

These and other features and advantages of the present invention will be apparent from the following detailed description, taken in combination with the accompanying drawings.

DESCRIPTION OF THE PREFERRED EMBODIMENTS

Figure 1:
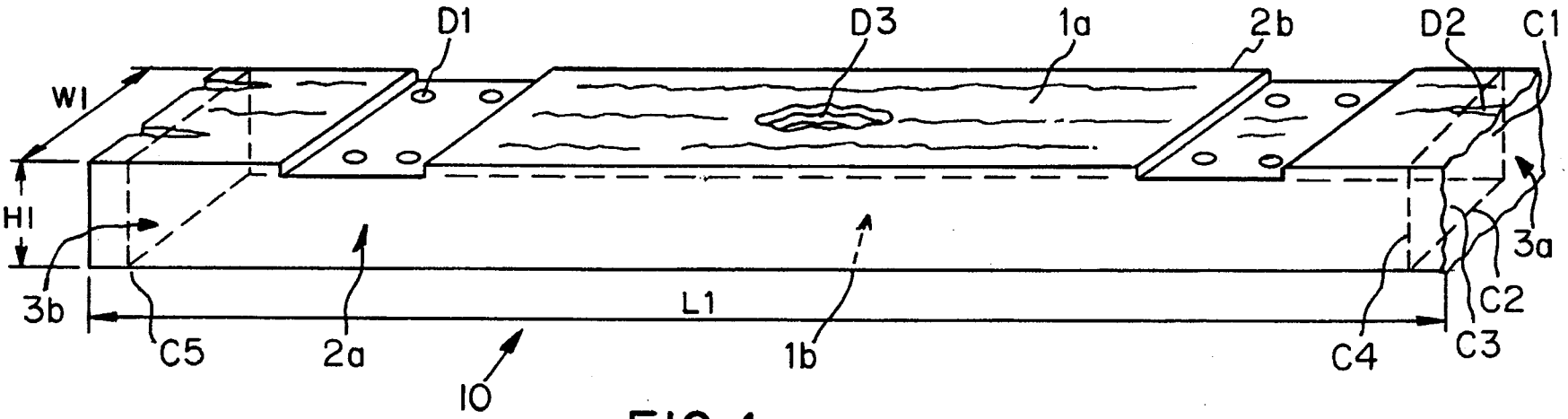
FIG. 1 is a perspective view of a used and worn out wooden tie.

As shown in FIG. 1, the railroad tie, generally designated 10, is rectangular in shape and has dimensions indicated by letters L1, W1 and H1 defining the length, width and height of the tie, respectively. The top surface 1*a* is the surface on which the rails, not shown in FIG. 1, are placed and affixed with spikes. The top surface 1*a* is substantially parallel to the bottom surface 1*b* and is substantially perpendicular to the side surfaces 2*a* and 2*b* and the end surfaces 3*a* and 3*b*. However, the present invention may be applied to a tie having a different shape such as one having a trapezoidal cross-section.

In the present description of an embodiment of the invention, an exemplary tie has a length, width and height of 8 feet, 9 inches, and 7 inches, respectively. However, the present invention may be applied to railroad ties of any size.

In the present specification, the longitudinal, lateral and vertical directions of the railroad tie are defined as the directions in which the length, width and height are respectively measured.

FIG. 1 also shows some of the defects that a used railroad tie may have. Spike holes are shown at D1. Longitudinal cracks are shown at D2. There are generally two types of cracks: checks and splits. Checks are usually shallow and about 1½ inches deep, at the most. However, splits may run deeper. D3 indicates a damaged portion on a surface which may be caused by sunlight, particularly ultraviolet rays, or by loss of preservative such as creosote. These unrecyclable defects generally need to be removed in the process of recycling the railroad tie. Although it is desirable to remove all the defects in used railroad ties, it is, in practice, difficult to do so. Therefore, some defects may be left in the ties so long as the new and recycled ties satisfy regulations such as the regulations specified in Chapter 3 of the *Manual for Railway Engineering* published by the American Railway Engineering Association.

The process of recycling the used railroad tie 10, according to the present invention, is described next with reference to FIGS. 2–5. In the description that follows, the grain is assumed to run in the longitudinal direction of the railroad ties. The act of cutting wood generally parallel to the grain will be referred to as rip-cutting. Similarly, cross-cutting is the cutting of wood in a direction generally perpendicular to the grain of the wood.

The first step is to locate and remove non-wood objects, such as spikes and anti-splitting irons (not shown), in order to allow for planing and cutting the ties into usable wooden pieces. Locating non-wood objects is usually performed visually. However, x-ray equipment may be used to locate hidden spikes and such. This step of locating non-wood objects may be automated to save time and labor. Most spikes are removed when the ties are removed from the railroad tracks. Broken spikes, which are generally left in by the railroad companies, can be removed in a number of ways. They can be driven down through the tie and out the other side. A hole saw can be used to cut a plug around the spike to remove both the spike and plug of surrounding wood. This is particularly useful for broken-off screw spikes. If it is possible to get a grip on a spike, it can be pulled out with a spike puller or a pair of locking pliers. Anti-splitting irons are removed by either prying or pulling out, using pry bars and pliers, or if that fails, by cutting off the end of the tie.

The second step is to plane the top surface 1*a*, the bottom surface 1*b* and one of the side surfaces 2*a* or 2*b*. The cutting planes are indicated with dotted lines C1, C2 and C3 in FIG.1. As can be seen in FIG. 1, the cuts are made substantially parallel to respective side surfaces. For example, removal of the top surface 1*a* is made substantially parallel to the top surface 1*a*. This step is performed to improve the efficiency of the subsequent sawing operations. By planing the top and bottom of the used tie 10, the saw kerf and the resulting loss of usable wood is reduced in the cutting process described below. By planing one side of the used tie, a finished smooth edge is provided which allows for efficient feeding into the saw, reducing the likelihood of jamming the saw. The fourth side of the used tie does not need to be planed since it will be discarded as scrap after the cutting process.

The third step of recycling the used railroad tie 10 according to the present invention is to cut off both ends 3*a* and 3*b* of the used ties. The cuts, shown in FIG. 1 by dotted lines C4, and C5, are made substantially perpendicular to the longitudinal direction of the tie and substantially parallel to the end faces 3*a* and 3*b*. This step is performed to remove the least desirable wood for re-use, which is the last few inches, typically between 2–3 inches of wood on the end. Another reason to cut off both ends is to provide a flush cut end for butting the ties up against each other as they are fed into the saw in a later cutting process.

The first, second and the third steps are performed to remove the unrecyclable portion near the surface of the used tie. The surface of the used wooden tie must be removed at some point in the recycling process since an adhesive agent will not bond to an oily surface, when later in the process, recyclable wooden pieces are put together to form a new and solid railroad tie. Also, an ultraviolet damaged surface is not sturdy enough for bonding. In these steps, typically ⅜ to ½ inch, is discarded. However, complete removal of the undesired portions is difficult to perform and is not economical in practice; therefore, some undesired portion may be left on the recycled wood. Recyclable wooden portions are defined to be portions of wood that can be recycled to form a tie which satisfies the regulations identified above.

Figure 2:
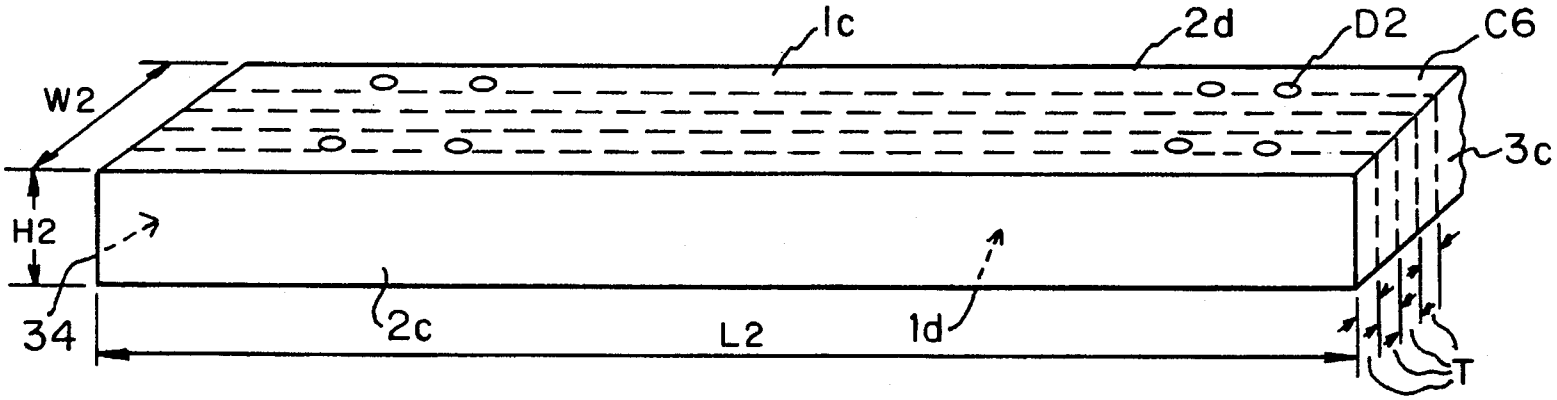
FIG. 2 is a perspective view of a wooden tie after undesired surface portions are removed.

FIG. 2 shows the railroad tie after the removal of three side surfaces and both ends. One of the side surfaces, 2*d*, is not planed. As shown in FIG. 2, removal of the exterior surface is often not enough to remove spike holes D2. The new length, width and height are indicated by L2, W2 and H2, respectively. This piece of wood is then cut substantially vertically in the longitudinal direction into pieces of wood having equal widths. That is, the cutting blade is positioned vertically and is moved relative to the wood along the longitudinal direction. The cutting planes are indicated by dotted lines C6. This fourth step is carried out with a gang saw having a plurality of vertical blades with substantially equal blade spacing to increase productivity efficiency. That is, the blades are positioned substantially perpendicular with respect to the top surface 1*c*. Since this cutting is generally along the grain of the wood, a gang rip saw is used in this process.

There are several factors to be considered in determining the thickness T of the wooden pieces. One factor is the total amount of adhesive agent required in putting the pieces together when they are assembled into a new railroad tie in a later process. As the tie is cut into smaller size strips, the total amount of adhesive required to put the pieces into a new tie is increased, therefore, increasing the cost. Smaller strips also increase kerf losses, thus reducing the yield of usable wood from the used ties. On the other hand, larger strips require less adhesive and have lower kerf losses but are less likely to remove imperfections in the used ties. A compromise between smaller and larger strips is the most practical solution. Strips between 1 and 2.33 inches are generally practical sizes. It appears that 1.4-inch and 1.75-inch strips are the most economical based on current costs of adhesive, labor and the selling price of new ties. The 1.4-inch strips would be laminated five high to achieve a 7-inch tie. The 1.75-inch strips are laminated four high to achieve a 7-inch tie. In any case, it is preferable to choose the thickness T such that it is given by the height of a finished and new tie divided by an integer, such as 5 in case of the 1.4-inch strips and 4 in case of the 1.75-inch strips.

Figure 3A:
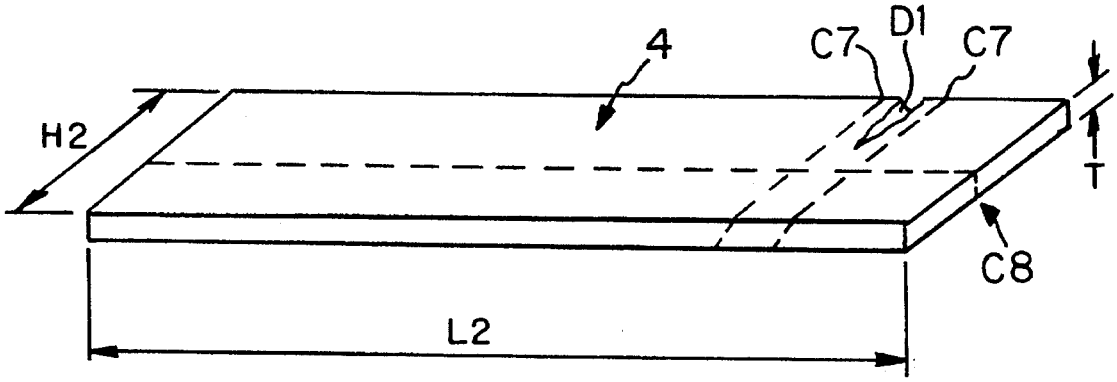
FIG. 3A is a perspective view of a wooden piece cut from a used wooden tie.
Figure 3B:
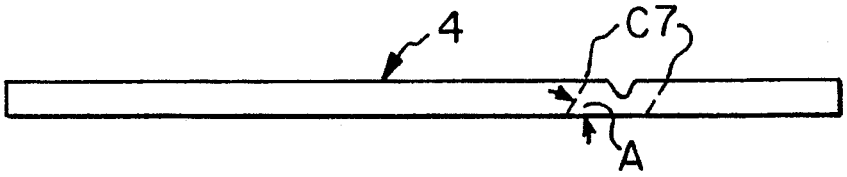
FIG. 3B is a side view of the wooden piece shown in FIG. 3A showing the angle of the cut made to remove a defect.

FIG. 3A shows a typical strip of wood after the fourth step. As seen from FIG. 3A, the wooden strip is rotated 90° from the original position of the tie shown in FIG. 2. It may still have a defect, for example, a spike hole D1. If the strip of wood does not have any defects at this point, it will be sent to the next step. If the strip does have a defect such as one shown at D1, then it will be cross-cut as the fifth step, with respect to the grain of the tie, as shown with dotted line C7 to remove the portion with the defect. As shown in FIG. 3B, the cut C7 is made at an angle A on the order of 45°. As can be easily understood, the surface 4 is substantially parallel to the side surfaces 2*a* and 2*b* of the original used railroad tie. This cut angle is to allow for strengthened end-to-end scarf joints of the wooden strips when they are assembled. Alternatively, the strips may be cut perpendicularly to the surface 4, which would be easier to accomplish. In this case, the wooden pieces would butt against each other when they are assembled into a beam so that the positions of these joints between adjacent layers of wooden strips are offset from each other in order to maximize the structural strength of the tie. In general, the angled joint will be stronger than the butt joint.

After the cross-cutting, the length of these strips is entirely at random. The longer strips are most desirable since they require the least handling. The strips can be cut as short as clamp spacing allows at the time of the cutting. An 18-inch clamp spacing would allow pieces to be as short as 18 inches. At least one clamp should contact the short length pieces.

After removing the defective portion in the fifth step, the pieces of wood are rip-cut into suitable sizes for assembling in the sixth step. To build a tie 9 inches in width, for example, the strips would be cut into two complementary widths; 4 inches and 5 inches. Wooden pieces with complementary widths are defined as a plurality of wooden pieces that have a combined width suitable for a new railroad tie when they are laid side-by-side. Other examples of complementary widths for a 9-inch wide tie are 3½ and 5½ inches and 3 and 6 inches, respectively. To construct a tie with an 8-inch width, examples of complementary widths are 2 and 6 inches and 3½ and 4½ inches, respectively.

The seventh step is to roll-coat the wooden pieces with a coupling agent which enhances the adhesion of adhesives to wooden materials. Hydroxymethylated resorcinol (HMR) coupling agent is used in the preferred embodiment. The primary purpose of using HMR is to create a chemical bonding between the cellulosic wood fibers and the adhesive agent. The characteristics of the wood surface change when the surface is exposed to air for a prolonged period of time. Therefore, the cutting of the wooden pieces and application of HMR needs to be performed relatively promptly within the time period before the wood surface looses its bonding characteristics.

The next and eighth step is to apply an adhesive to the surfaces of wooden pieces. In the present preferred embodiment, resorcinol-formaldehyde is used, which allows for room temperature curing and results in waterproof and oil-proof adhesive bonds. The best result is obtained in a temperature between 70° and 90° F. Other adhesives such as phenolic, melamine-formaldehyde, isocyanate and epoxy may be used but are less economical.

Figure 4:
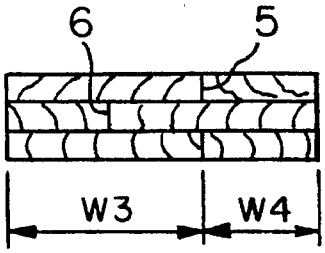
FIG. 4 is an end view of the assembled new tie showing the staggered positioning of the wooden pieces to obtain maximum structural strength.

Wooden pieces are then assembled into a wooden beam having height and width dimensions suitable for a railroad tie. This may be accomplished by laying two or more wooden pieces having complementary widths W3 and W4 in FIG. 4, side-by-side, to form a layer. Another layer is constructed in a similar manner. One of the layers is placed on top of the other in such a manner that the boundary 5 between two adjacent wooden pieces in one layer does not coincide with and is offset from the joint 6 between two adjacent wooden pieces in another layer as schematically shown in FIG. 4. In other words, the widths are staggered in the vertical direction of the layers. This is accomplished to maximize the strength of the structure. If each layer is 1.4 inches high, five of these layers are placed on top of one another to form a tie 7 inches high.

The pieces are also placed lengthwise to form a beam of 8–40 feet in length. It is generally more efficient to form the beam in lengths as long as practical and then cut the beam to the desired railroad tie length. This tends to optimize the efficiency of the overall operation.

An example of how to assemble pieces of wood lengthwise is described as follows. To construct a 7-inch by 9-inch railroad tie having five layers of 1.4-inch strips of wood, two pieces of wood A and B having widths of 4 and 5 inches, respectively, are laid side-by-side to form a layer. This process is repeated to form five layers positioned in a staggered fashion described above. Then, in order to construct a beam of longer length, another piece of wood C, which is 4 inches wide and 1.4 inches high, is placed behind the wooden piece A identical in width and height. A wooden piece D which is 5 inches wide and 1.4 inches high would be placed behind the wooden piece B identical in width and height. One needs to keep in mind that the wooden pieces A and B may have different lengths, although they have substantially identical heights and complementary widths. This process is repeated with each layer. The process just described is the simplest way to construct a beam. This step may be accomplished in any other way as long as the width and the height of the beam are desirable for a railroad tie. The step of assembling the wooden pieces to a beam needs to be done within a predetermined time period which is the pot life of the adhesive in use. Otherwise, the adhesive would start to loose its bonding ability. For resorcinol-formaldehyde, the pot life is about 20 minutes.

The assembly needs to be held under pressure while allowing the adhesive agent to cure. This is accomplished with the use of a clamping device for a duration of approximately 24 hours at room temperature. The clamping device used in this particular embodiment of the invention is a frame clamp which has a general shape of a rectangle and which can apply pressure in two directions at the same time. A pressure of approximately 250 psi is maintained by the clamps to spread out the adhesives between wooden pieces and also to remove air holes. Spreading of the adhesives reduces the amount of adhesive agent required. Removal of air holes strengthens the bonding between two wooden pieces.

For the best result, a temperature between 70° and 90° F. is maintained for resorcinol-formaldehyde to cure. There is an advantage of using an adhesive that cures best in room temperature. If the wooden assembly needs to be cured at a higher temperature, the wood tends to expand at elevated temperatures and then contract when it is cooled. This can cause distortion in the structure.

The beam is then freed from the clamping equipment and is rip-cut into 8-foot lengths. Other lengths, such as 8 feet, 6 inches and 9 feet, are also used. Maximum crosslinking of the adhesive is achieved in about seven days. The assembly is then planed to remove any surface imperfections and is treated with a preservative such as creosote. Finally, anti-splitting irons can be attached to the surface of the assembly as is customary in the art.

The resultant structure of the tie manufactured according to the above-described method is as follows. The recycled railroad tie has layers of recycled wooden pieces with substantially the same heights. Each layer is disposed substantially parallel to the top surface and includes more than one wooden piece having complementary widths and is disposed side-by-side or substantially parallel to said top surface. Further, each layer includes more than one wooden piece having a complementary length disposed adjacent to each other lengthwise of said railroad tie. The new and recycled wooden tie has layers of adhesive agent between any two surfaces of said wooden pieces and a layer of protective agent, such as creosote, on each exterior surface.

In theory, about ¾ of the wood from an average used tie should be recyclable, but the use of ½ of the used tie can still result in an efficient and economical method.

A test result shows that the recycled ties manufactured according to the present invention are less expensive and of equal quality as compared to new ties. In particular, during a shearing force test of used tie pieces, the wood fiber broke before the adhesive portion broke. The resultant ties can be handled and used in exactly the same manner as new hardwood ties.

Figure 5:
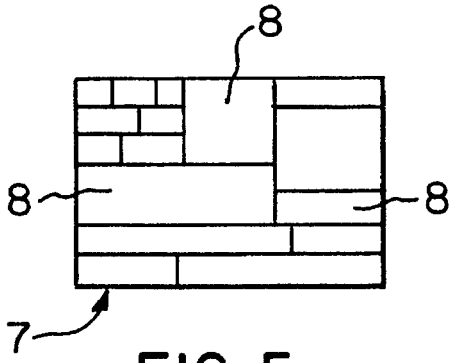
FIG. 5 is an end view of an assembled new tie showing the arrangement of the usable pieces of wood in a railroad tie according to a different embodiment of the invention.

I have described the most preferred embodiment of the present invention. However, several modifications of the embodiment are contemplated within the scope of the present invention. For example, while the ties are cut into strips having substantially equal thicknesses in the fourth step in the preferred embodiment, they may be cut into strips having different thicknesses to increase the amount of recyclable portion of the ties. The ties may be cut in different sizes as long as the pieces have complementary dimensions to achieve proper dimensions for a new tie. FIG. 5 shows an example of such an arrangement seen from an end 7 in which multiple pieces 8 of different dimensions are so assembled.

While embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A method of recycling used wooden railroad ties to form a new railroad tie, each of said used railroad ties having a top surface for receiving a railroad track, a side surface and an end surface, said method comprising the steps of:

removing an unrecyclable surface portion of a used railroad tie;

longitudinally cutting said used railroad tie into a plurality of usable wooden pieces having complementary dimensions whereby said wooden pieces may be assembled into a beam having a width and height of a railroad tie without leaving substantial space between any two adjacent wooden pieces, wherein said step of cutting said railroad ties includes the steps of:

rip-cutting said railroad ties longitudinally to produce wooden pieces with substantially the same thickness, said thickness is determined by dividing the height of a railroad tie by an integer, cross-cutting said railroad ties to remove an unrecyclable portion, and rip-cutting said wooden pieces to obtain usable wooden pieces with complementary widths such that said wooden pieces may be placed adjacent to one another on a plane to produce a width appropriate for a railroad tie;

applying adhesive agent to a surface on each of said usable wooden pieces;

assembling said usable wooden pieces into a beam having a plurality of substantially horizontal layers of said usable wooden pieces which are formed by said longitudinal cutting of said used railroad tie, and having a width and height of a railroad tie; and allowing said adhesive agent to cure.

2. A method of recycling used wooden railroad ties according to claim 1, wherein said step of removing an unrecyclable surface portion includes a step of removing at least one of a) non-wood support structure;

b) a portion having an attachment hole;

c) a damaged portion, said damaged portion including at least one of c-1) a weathered portion, c-2) an ultraviolet damaged portion, or c-3) a cracked portion;

d) a portion treated with preservative; and e) both ends of said railroad ties.

3. A method of recycling used wooden railroad ties according to claim 1, wherein said step of removing an unrecyclable surface portion includes a step of planing at least one side of each of said used railroad tie prior to said longitudinal cutting of said used railroad ties.

4. A method of recycling used wooden railroad ties according to claim 1, wherein said adhesive agent is resorcinol-formaldehyde.

5. A method of recycling used wooden railroad ties according to claim 1, wherein said step of cross-cutting said used railroad ties is performed such that the cut angle is substantially less than 90° with respect to a surface parallel to said side surface of a used railroad tie.

6. A method of recycling used wooden railroad ties according to claim 5, wherein said thickness ranges between 1 and 2.33 inches.

7. A method of recycling used wooden railroad ties according to claim 1, wherein said step of assembling said usable wooden pieces includes a step of assembling said wooden pieces with complementary widths to form a layer of wooden pieces and placing said layer on another layer similarly formed such that a boundary between two wooden pieces in said layer is horizontally offset from a boundary between two wooden pieces in said another layer.

8. A method of recycling used wooden railroad ties according to claim 1 further including the steps of:

applying coupling agent to said usable wooden pieces prior to said step of applying said adhesive agent; and applying pressure to said assembly of said usable wooden pieces for a predetermined amount of time during said step of allowing said adhesive to cure.

9. A method of recycling used wooden railroad ties according to claim 1 further including a step of cutting said assembled usable wooden pieces to a length suitable for a railroad tie after said steps of assembling.

10. A method of recycling used wooden railroad ties according to claim 1, wherein said step of allowing said adhesive agent to cure is carried out in a temperature between 70° add 90° F.

11. A method of converting used railroad ties having top, side and end surfaces into new railroad ties comprising:

removing unusable surface portions from at least one of said top, side and end surfaces of said used railroad ties including planing at least one said side of each said used railroad tie;

longitudinally cutting said used ties into a plurality of usable pieces having complementary widths capable of being assembled into a beam of a desired new railroad tie width and height, wherein said cutting of said used railroad ties into usable pieces includes the steps of:

rip-cutting said used ties longitudinally to produce wooden pieces with substantially the same thickness, said thickness is determined by dividing the height of a railroad tie by an integer, removing unusable internal portions exposed during forming said usable pieces including cross-cutting said used ties to remove unusable internal portions, and rip-cutting said used ties to obtain usable pieces with complementary widths such that said wooden pieces may be placed adjacent to one another upon a plane to produce a width appropriate for a railroad tie;

applying a resorcinol-formaldehyde adhesive agent to respective surfaces of said usable pieces to be joined during assembly;

assembling said usable pieces into a beam having the width and height of a new railroad tie and a length in excess of that of a new railroad tie;

curing said beam under pressure and at room temperature; and cutting said beam to a preferred length to form a new railroad tie.

12. A method of converting used railroad ties according to claim 11, wherein said thickness is between 1 and 2.33 inches.

13. A method of converting used railroad ties according to claim 11, wherein said step of assembling said usable wooden pieces includes the step of assembling said wooden pieces and placing said layer on another layer similarly formed such that a boundary between two wooden pieces in said layer is horizontally offset from a boundary between two wooden pieces in said another layer.

14. The method of claim 11 wherein said assembly of said usable pieces includes forming said beam of multiple railroad tie lengths and said cutting of said beam includes cutting said beam into a plurality of individual railroad ties.

15. A method of converting used railroad ties according to claim 11 further including the step of applying coupling agent to said usable wooden pieces prior to applying a resorcinol-formaldehyde adhesive agent after said unusable internal portions have been removed.

16. A method of converting used railroad ties according to claim 11, wherein said cross-cutting is performed at an angle of 45° or greater with respect to one said side surface of said used railroad tie.

* * * * *